US006274030B1

(12) United States Patent
Wallace et al.

(10) Patent No.: US 6,274,030 B1
(45) Date of Patent: Aug. 14, 2001

(54) FILTRATION OF FEED TO INTEGRATION OF SOLVENT DEASPHALTING AND GASIFICATION

(75) Inventors: Paul S. Wallace, Katy; Kay Anderson Johnson, Missouri City, both of TX (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/469,998

(22) Filed: Dec. 22, 1999

Related U.S. Application Data

(60) Provisional application No. 60/113,449, filed on Dec. 23, 1998.

(51) Int. Cl.[7] ..... C10C 1/18; C10G 33/00; C10G 1/04

(52) U.S. Cl. ..... 208/45; 208/34; 208/180; 208/187; 208/309; 208/391; 208/428

(58) Field of Search ..... 208/34, 45, 180, 208/187, 428, 391, 309

(56) References Cited

U.S. PATENT DOCUMENTS

| | | | |
|---|---|---|---|
| 2,818,326 | 12/1957 | Eastman et al. | 48/196 |
| 3,617,481 | 11/1971 | Voorhies, Jr. et al. | 208/50 |
| 4,099,382 | 7/1978 | Paull et al. | 60/648 |
| 4,178,758 | 12/1979 | Paull et al. | 68/648 |
| 4,239,616 | 12/1980 | Gearhart | 208/321 |
| 4,273,644 | 6/1981 | Harris et al. | 208/309 |
| 4,391,701 | 7/1983 | LePage et al. | 208/370 |
| 4,732,664 | 3/1988 | Sobri Martini et al. | 208/97 |
| 5,362,382 | 11/1994 | Heck et al. | 208/210 |
| 5,472,986 | 12/1995 | van Dijk | 518/705 |
| 5,474,977 | 12/1995 | Gatsis | 502/172 |
| 5,607,575 | 3/1997 | Kamiya et al. | 208/251 |
| 5,624,844 | 4/1997 | Xu et al. | 435/264 |
| 5,785,860 | 7/1998 | Smith | 210/651 |
| 5,814,286 * | 9/1998 | Hood et al. | 422/256 |
| 5,843,301 | 12/1998 | Esztergar et al. | 208/309 |
| 5,968,349 * | 10/1999 | Duyvesteyn et al. | 208/309 |

OTHER PUBLICATIONS

Perry & Chilton "Chemical Engineering Handbook", 5 edition, p. 13–3.*

* cited by examiner

*Primary Examiner*—Walter D. Griffin
*Assistant Examiner*—Tam M. Nguyen
(74) *Attorney, Agent, or Firm*—Morris N. Reinisch; Howrey Simon Arnold & White

(57) ABSTRACT

The invention is a process of removing solids, particularly catalyst fines, from an asphaltene-containing hydrocarbon liquid. The process comprises contacting an asphaltene-containing hydrocarbon liquid with a solvent to create a mixture. The solvent is typically an alkane such as, propane to pentanes. Then, solids are removed from the mixture by any known process. Finally, additional solvent may be added, and the mixture heated until asphaltenes precipitate into a separate phase. The asphaltenes are removed from the mixture. The mixture is then further heated to recover the solvent from the deasphalted hydrocarbon liquid. The asphaltenes are advantageously gasified.

22 Claims, No Drawings

FILTRATION OF FEED TO INTEGRATION OF SOLVENT DEASPHALTING AND GASIFICATION

Priority of U.S. Provisional Application Ser. No. 60/113,449, filed Dec. 23, 1998 is hereby claimed.

FIELD OF THE INVENTION

The invention relates a process for the extraction and gasification of asphaltenes from oil, heavy oil, or vacuum or distillate residuum. More particularly, the invention relates to the removal of solids from heavy hydrocarbonaceous streams that contain asphaltenes, and the subsequent separation and removal of asphaltenes for gasification.

BACKGROUND OF THE INVENTION

The process and advantages of gasifying hydrocarbonaceous material into synthesis gas are generally known in the industry. In high temperature gasification processes, a hot partial oxidation gas is produced from hydrocarbonaceous fuels, for example coal, oils, hydrocarbon wastes, and the like. In these processes, the hydrocarbonaceous fuels are reacted with a reactive oxygen-containing gas, such as air or oxygen, in a gasification reactor to obtain the hot partial oxidation gas.

In the reaction zone of a gasification reactor, the hydrocarbonaceous fuel is contacted with a free-oxygen containing gas, optionally in the presence of a temperature moderator. In the reaction zone, the contents will commonly reach temperatures in the range of about 1,700° F. (930° C.) to about 3,000° F. (1650° C.), and more typically in the range of about 2,000° F. (1100° C.) to about 2,800° F. (1540° C.). Pressure will typically be in the range of about 1 atmosphere (100 Kpa) to about 250 atmospheres (25,000 KPa), and more typically in the range of about 15 atmospheres (1500 Kpa) to about 150 atmospheres (1500 KPa).

In a typical gasification process, the hot partial oxidation gas will substantially comprise hydrogen, carbon monoxide, and lessor quantities of water, carbon dioxide, hydrogen sulfide, carbonyl sulfide, ammonia, and nitrogen.

The partial oxidation process in a free-flow, down-flowing vertical refractory lined steel pressure vessel is known. An example of such a process and pressure vessel are shown and described in U.S. Pat. No. 2,818,326, which is hereby incorporated by reference.

This refractory barrier is made of any suitable refractory material, i.e., alumina, chromia, magnesia, or mixtures thereof. This refractory brick is exposed to the gasification zone. For feedstock that has significant quantities of slag, i.e., greater than about 0.1 percent by weight of total feed, then refractory bricks are preferably constructed of more slag-resistant refractory material such as high chromia, magnesia, or mixtures thereof. Particulate carbon, ash, and/or molten slag typically containing species such as $SiO_2$, $Al_2O_3$, and the oxides andoxysulfides of metals such as Fe and Ca are commonly produced during gasification of certain feedstock.

In many applications the fuel contains significant quantities of ash and slag. At gasification temperatures the ash and slag may be partially or fully molten. It is generally preferred to keep the ash and slag in the molten state until it leaves the gasification reactor. Otherwise, particulate matter can accumulate and plug the reactor. However, this molten ash and slag, is very harsh to surfaces it contacts. The molten ash and slag attacks refractory brick, and this brick needs to be periodically replaced.

The refractory barriers, as well as burners, coolers, and instrumentation, have short life spans in the environment present in a gasification process, particularly in the presence of molten slag. The environment is very severe on non-refractory materials. An unprotected thermocouple left in this environment is rendered useless by corrosion in as little as ten minutes.

What is needed is a method to economically remove ash-forming materials from gasifier feedstock.

SUMMARY OF THE INVENTION

The invention is a process of removing solids from an asphaltene-containing hydrocarbon liquid prior to recovering asphaltenes. The process comprises contacting an asphaltene-containing hydrocarbon liquid with an alkane solvent to create a mixture. The alkane solvent is typically propane, butanes, pentanes, or mixtures thereof The viscosity of the liquid is then reduced so that entrained solids can be removed from the mixture by, for example, centrifugation, filtering, or gravity settling. Then, the asphaltenes are precipitated into a separate fluid phase. The precipitation may be initiated by adding additional solvent, and/or the mixture heated, until asphaltenes precipitate into a separate phase. The substantially solids-free asphaltenes are removed from the mixture. The recovered solids-free asphaltenes are gasified.

Optionally, the deasphalted, substantially solids-free mixture is then further heated to recover the solvent.

DETAILED DESCRIPTION OF THE INVENTION

The invention is a process of sequentially removing solids and then asphaltenes from an asphaltene-containing hydrocarbon liquid. The process is applicable to an asphaltene-containing hydrocarbon liquid. This material is usually a fluid such as an oil or a heavy oil. During the distillation of crude oil, as employed on a large scale in the refineries for the production of light hydrocarbon oil distillates, a residual oil is often obtained. The process is also applicable for this residual oil. The asphaltene-containing hydrocarbon liquid may even appear to be a solid, especially at room conditions. The asphaltene-containing hydrocarbon liquid should be at least partially miscible with the solvent at extraction temperatures.

Many crude oils and residual oils from processing contain significant quantities of asphaltenes. It is desirable to remove the asphaltenes from the oil, because asphaltenes tend to solidify and foul subsequent processing equipment, and because removal of asphaltenes lowers the viscosity of the oil. Solvent extraction of asphaltenes is used to process residual crude. The products of solvent extraction are deasphalted oil which may be subsequently hydrotreated and then catalyticly cracked and made into predominantly diesel, and lower value asphaltenes.

The light components are recovered using solvent extraction and sold as valuable products. The asphalt component is converted in gasification units into products such as hydrogen, carbon monoxide, and combustion turbine fuel.

Heavy oils typically contain entrained solid particles. Particulate carbon or coke, ash, and species such as $SiO_2$, $Al_2O_3$, and the oxides and oxysulfides of metals such as Fe and Ca typically exist These may originate from the producing formation as sand or clays or may have been picked up by the high viscosity oil during transportation and processing. Residual oils or oils having prior treatment may also contain residual catalyst fines. Such catalysts typically comprise metals of the group VIA or the group VIII of the Periodic Table supported on a supporter comprising an iron-containing aluminosilicate and inorganic oxides.

The first step in the deasphalting process of the present invention is contacting an asphaltene-containing hydrocarbon liquid with an alkane solvent to create a mixture. The term "alkane solvent" means a liquid containing at least about 70, preferably over 90, weight percent alkanes. The alkanes may range from propane to heptanes, though the solvent often comprises only propane, butanes, and pentanes at concentrations above about 10% by weight. The solvent is most typically a mixture of propane and butanes.

It is advantageous to maintain the temperature and pressure such that the asphaltene-containing hydrocarbon material and the low-boiling solvent are fluid or fluid like. The asphaltene-containing hydrocarbon liquid and solvent are advantageously hot, i.e., between about 120° F. (48° C.) to about 700° F. (371° C.), more typically between about 150° F. (65° C.) and about 350° F. (177° C.).

The extraction of asphaltenes from an asphaltene-containing hydrocarbon liquid with a low-boiling solvent is known. See, for example, U.S. Pat. Nos. 4,391,701 3,617,481, and 4,239,616, the disclosures of which are incorporated herein by reference. The known deasphalting involves contacting the solvent with the asphaltene-containing hydrocarbon material in an asphaltene extractor. Certain additives, including lighter oils, aromatic wash oils, inorganic acids, and the like may be added to improve the efficiency of the deasphalting operation. The contacting may be done in batch mode, as a continuous fluid-fluid counter-current mode, or by any other method known to the art.

The choice of solvent depends on the quality of the oil. As the molecular weight of the is solvent increases, the amount of solvent needed decreases but the selectivity, for example to resins and aromatics, decreases. Use of propane as the solvent requires more solvent than, for example, hexane, but propane also does not extract as much of the aromatics and resins. It is desirable to keep the aromatics with the hydrocarbon mixture.

The process comprises contacting an asphaltene-containing hydrocarbon liquid with a solvent to create a mixture. The solvent is typically an alkane of a composition as is used for normal deasphalting. As solvent is added to the heavy oil, the viscosity of the mixture declines. It is advantageous to maintain the temperature between about 120° F. (48° C.) and about 350° F. (177° C.) to maintain a low viscosity and to facilitate mixing. Lower temperatures will minimize possible premature precipitation of asphaltenes. After some or all of the solvent has been added to the asphaltene-containing hydrocarbon liquid, but before the asphaltenes precipitate out, the entrained solids are removed from the mixture. The solids are removed from the mixture once the viscosity of the mixture allows solids removal by conventional techniques.

These solids may include silica, alumina, iron, clays, suspended or entrained catalyst fines, and the like. In some refinery applications such as catalytic cracking or hydrogenating the heavy oil is exposed to and picks up catalyst fines. The high viscosity of the oil precludes filtration of the entrained catalyst fines. The fines are less than 400 microns with some particles less than 1 micron.

After the entrained solids are removed, the mixture is heated and/or additional solvent added until asphaltenes precipitate as a separate but at that temperature fluid phase. The mixture may need to be heated by between about 150° F. (65° C.) and 350° F. (177° C.), for example from about 150° F. (65° C.) to about 450° F. (233° C.), to precipitate the asphaltenes. The temperatures depend on the quantity and type of asphaltenes and solvent used. It may also be advantageous to add additional solvent, for example sufficient solvent to contain from about 12 to about 20 barrels per barrel (1 barrel=158.987 liters) of asphaltene-containing liquid originally present. The substantially solids-free asphaltenes are then removed from the mixture by any conventional method, for example by filtering, by gravity separation, or by centrifugation.

By substantially solids free it is meant that the precipitated asphaltenes contain less than about 50% by weight, and more preferably less than about 20% by weight, of the entrained solids originally in the asphaltene-containing liquid.

The solvent is advantageously recovered as is done in a traditional solvent deasphalting process so no additional energy is required to separate the solvent from the oil. This generally requires additional heating of the solvent-deasphalted liquid mixture to, for example, between about 400° F. (204° C.) and 700° F. (371° C.). The deasphalted mixture is further heated to recover the solvent from the deasphalted hydrocarbon liquid. This recovery may be via distillation or supercritical separation. High pressure steam or a fire heat is typically used to heat the deasphalted oil-solvent mixture to sufficient temperature. The oil portion then separates from the solvent without having to vaporize the solvent. This reduces energy consumption by about 20 to 30 percent over separating off and recovering the solvent for re-use.

If the solids are not separated from the asphaltene-containing liquid prior to asphaltene precipitation, the solids settle in the solvent extraction process with the asphaltenes. Thereafter, they are fed to the gasifier. The minerals in the catalyst fines and other solids are problematic for the gasifier after because they are converted to molten slag and ash. The catalyst can damage the refractory that lines the gasifier. The catalyst can also deposit on the walls and throat of the gasifier, eventually causing a blockage. Therefore, oil containing entrained catalyst fines cannot be processed in the gasifier, leaving the refiner with a stream that is difficult to dispose of.

The process and advantages of gasifying hydrocarbon material such as asphaltenes into synthesis gas are generally known in the industry. With the prior separation and removal of solids, ash and molten slag are minimized in the reaction zone of a gasifier.

Removal of the solids may be by any means. One preferred embodiment utilizes filtration. The particles of solid may be very small. Therefore, the openings in the filter must be very small. The small opening are clogged by the viscose oil in the absence of the solvent.

In this invention the filtration is accomplished after at least a portion of the solvent for the solvent extraction is mixed with the feed. The quantity of solvent used in solvent extraction of asphaltenes may vary from about 4 barrels per barrel of asphaltene-containing liquid to about 20 barrels per barrel of asphaltene-containing liquid.

The added solvent reduces the mixture viscosity well before the total amount of solvent is added. The solids may in some cases be advantageously be removed after one volume solvent per volume of asphaltene-containing liquid is admixed. The amount of solvent added prior to removal of solids varies for a given asphaltene-containing liquid, as well as the temperature the mixture is at. It may in some cases be advantageous to add at least 2 barrels, or 4 barrels, or 8 barrels, or even 16 barrels of solvent to the asphaltene-containing liquid prior to removing liquids.

The added solvent reduces the viscosity of the mixture to the point where it can pass through the filter. The catalyst particles and other solids can be removed from the hydrocarbon stream. The oil can then be processed in the solvent deasphalter. The bottoms from the deasphalter, i.e., the asphaltenes, are then suitable for gasification.

The filter can be of any suitable type. One suitable ceramic filter is that described in U.S. Pat. No. 5,785,860, the disclosure of which is incorporated herewith by reference.

The solids can be separated by other suitable methods, such as by gravity separation or centrifugation.

Another method may be an electrodynamic method in which a strong electric field is imposed to collect solids, as is described in U.S. Pat. No. 5,843,301, the disclosure of which is incorporated herewith by reference.

Another method may be a magnetic method in which a strong magnetic field is imposed to collect solids, as is described in U.S. Pat. No. 5,607,575, the disclosure of which is incorporated herewith by reference.

The solids and fines removed from the heavy oil can be washed with the solvent from the deasphalter. The adhering hydrocarbon material can be recovered. The solids can be treated as necessary to separate sand, iron, and clays from more valuable catalyst, as needed. The recovered catalyst can be sent to a catalyst reclaimer. Therefore, no solid waste is generated.

The asphaltenes form crystals in the deasphalter in response to the selected conditions, which include the quantity and type of solvent and the temperature. The asphaltenes can be separated from the deasphalted hydrocarbon liquid via gravity separation, filtration, centrifugation, or any other method known to the art. The asphaltenes are fluid like at the deasphalting conditions. The asphaltene component that has very little value. Asphaltenes are a hydrocarbonaceous material suitable for gasification. See, for example, U.S. Pat. No. 4,391,701, the disclosure of which is incorporated herein by reference.

This process allows heavy oils contaminated with catalyst particles to be utilized in a deasphalting/gasification process. The light oils from the oil can be recovered using the solvent deasphalting process and sold. The heavy asphalt components can be converted to valuable products in the gasifier such as hydrogen, carbon monoxide, and fuel gas.

In one embodiment of this invention, a heavy asphaltene-containing oil contaminated with catalyst fines is mixed with an alkane solvent. The viscosity of the oil is thereby reduced allowing filtration of the oil and removal of the catalyst fines. The asphaltenes are then precipitated and recovered. The solvent is recovered in the deasphalting process. The light component, i.e., the deasphalted liquid, is separated and sold. The asphalt from the deasphalter is gasified to make products including but not limited to hydrogen, carbon monoxide, carbon dioxide, combustion turbine fuel, and boiler fuel.

The tern "hydrocarbonaceous" as used herein to describe various suitable feedstocks is intended to include gaseous, liquid, and solid hydrocarbons, carbonaceous materials, and mixtures thereof. This disclosure specifically includes asphaltenes. However, other hydrocarbonaceous material may be admitted. In fact, substantially any combustible carbon-containing organic material, or slurries thereof, may be included within the definition of the term "hydrocarbonaceous". Solid, gaseous, and liquid feeds may be mixed and used simultaneously; and these may include paraffinic, olefrinc, acetylenic, naphthenic, and aromatic compounds in any proportion. Also included within the definition of the term "hydrocarbonaceous" are oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials, and mixtures thereof.

The term "liquid hydrocarbon," as used herein to describe suitable liquid feedstocks, is intended to include various materials, such as liquefied petroleum gas, petroleum distillates and residue, gasoline, naphtha, kerosene, crude petroleum, asphalt, gas oil, residual oil, tar-sand oil and shale oil, coal derived oil, aromatic hydrocarbons (such as benzene, toluene, xylene fractions), coal tar, cycle gas oil from fluid-catalytic-cracking operations, firfiral extract of coker gas oil, and mixtures thereof. "Gaseous hydrocarbons," as used herein to describe suitable gaseous feedstocks, include methane, ethane, propane, butane, pentane, natural gas, coke-oven gas, refinery gas, acetylene tail gas, ethylene off-gas, and mixtures thereof. "Solid hydrocarbon fuels," as used herein to describe suitable solid feedstocks, include, coal in the form of anthracite, bituminous, subbituminous; lignite; coke; residue derived from coal liquefaction; peat; oil shale; tar sands; petroleum coke; pitch; particulate carbon (soot or ash); solid carbon-containing waste materials, such as sewage; and mixtures thereof. Certain types of hydrocarbonaceous fuels, in particular coal and petroleum coke, generate high levels of ash and molten slag.

As used herein, the term "precipitate" in the context of precipitating asphaltenes means the asphaltene-rich material forms a second phase, which may be and is preferably a fluid or fluid-like phase. In a preferred embodiment of this invention, the precipitated asphaltene-rich material is pumped to the gasifier. A solid asphaltene-rich phase that may form on cooling is not preferred because of handling problems.

As used herein, the term "gasification zone" refers to the reactor volume in which hydrocarbon feed material, particularly asphaltene-rich hydrocarbonaceous liquid, is mixed with an oxygen containing gas and is partially combusted.

As used herein, the terms "deasphalted hydrocarbon liquid" or "deasphalted oil", are used interchangeably to refer to the oil soluble in the selected deasphalting solvents at the conditions selected for the deasphalting operation.

As used herein, the term "asphaltenes" is defined as it is normally used in the industry. Some examples of industry definitions are heptane-insolubles, or toluene-solubles, or the material that forms a separate phase when a hydrocarbon mixture is contacted with a solvent comprising primarily propane to hexane alkanes.

While the devices, compositions and methods of this invention have been described in terms of preferred embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A process of removing solids from an asphaltene-containing hydrocarbon liquid, said process comprising in order:

a) contacting an asphaltene-containing hydrocarbon liquid with a solvent to form a mixture, said mixture having a lower viscosity than the asphaltene-containing hydrocarbon liquid;

b) removing the solids from the mixture;

c) precipitating the asphaltenes from the mixture; and d) removing substantially solids-free asphaltenes from the mixture.

2. The process of claim 1 wherein the solvent is an alkane solvent with greater than 70 weight percent alkanes.

3. The process of claim 1 wherein the solvent is an alkane solvent with greater than 90 weight percent alkanes.

4. The process of claim 3 wherein the alkane solvent comprises one or more of propane, butanes, or pentanes.

5. The process of claim 1 wherein the solids in the asphaltene-containing hydrocarbon liquid comprise one or more of silica, alumina, iron, clays, suspended or entrained catalyst fines.

6. The process of claim 1 wherein the solids in the asphaltene-containing hydrocarbon liquid comprises catalyst fines.

7. The process of claim 6 wherein the catalyst fines comprise one or more of group VIA or the group VIII metals supported on a supporter comprising an aluminosilicate, a zeolite, or inorganic oxides.

8. The process of claim 1 wherein the asphaltene-containing liquid is contacted with at least one volume of solvent per volume of asphaltene-containing liquid.

9. The process of claim 1 wherein the asphaltene-containing liquid is contacted with at least two volumes of solvent per volume of asphaltene-containing liquid.

10. The process of claim 1 wherein the asphaltene-containing liquid is contacted with at least four volumes of solvent per volume of asphaltene-containing liquid.

11. The process of claim 1 wherein the asphaltene-containing liquid is contacted with at least eight volumes of solvent per volume of asphaltene-containing liquid.

12. The process of claim 1 wherein the asphaltene-containing liquid is contacted with at least sixteen volumes of solvent per volume of asphaltene-containing liquid.

13. The process of claim 1 wherein the solids are removed by one or more of gravity separation, centrifugation, filtration, magnetic separation, or electrodynamic separation.

14. The process of claim 1 wherein the solids are removed by filtration.

15. The process of claim 1 wherein the solids removed comprise catalyst fines, said process further comprising sending the catalyst to a catalyst reclaimer.

16. The process of claim 1 wherein the process of precipitating the asphaltenes comprises contacting the mixture with additional solvent.

17. The process of claim 1 wherein the process of precipitating the asphaltenes comprises heating the mixture.

18. The process of claim 1 wherein the temperature of the mixture is between about 120° F. to about 600° F.

19. The process of claim 1 wherein the temperature of the mixture during removal of the solids is between about 120° F. to about 350° F.

20. The process of claim 1 further comprising gasifying the substantially solids-free asphaltenes from the mixture.

21. The process of claim 1 further comprising recovering the solvent by distillation.

22. The process of claim 1 further comprising recovering the solvent by supercritical separation.

* * * * *